United States Patent [19]

McCauley

[11] Patent Number: 4,945,960

[45] Date of Patent: Aug. 7, 1990

[54] DOUBLE-ACTION VERTICAL WOOD SPLITTER

[76] Inventor: Christopher J. McCauley, Rt. 2, Box 320D, Hillsboro, N.H. 03244

[21] Appl. No.: 383,662

[22] Filed: Jul. 21, 1989

[51] Int. Cl.[5] ..... B27L 7/00

[52] U.S. Cl. ..... 144/193 A; 144/366

[58] Field of Search ..... 144/3 K, 193 R, 193 A, 144/366

[56] References Cited

U.S. PATENT DOCUMENTS

| | | | |
|---|---|---|---|
| 2,851,072 | 9/1958 | Gerjets et al. | 144/193 A |
| 3,319,675 | 5/1967 | Bles, Sr. | 144/193 A |
| 3,779,295 | 12/1973 | Balsbaugh | 144/193 A |
| 4,366,848 | 1/1983 | Gavinski | 144/193 A |
| 4,411,298 | 10/1983 | Ellingsen et al. | 144/193 A |
| 4,470,441 | 9/1984 | Winsbinski et al. | 144/193 A |
| 4,503,894 | 3/1985 | Gratkowski | 144/193 R |
| 4,782,870 | 11/1988 | Duerr | 144/193 R |

*Primary Examiner*—W. Donald Bray

[57] ABSTRACT

A double-action vertical wood splitter, intended to be mounted on a tractor or the like, splits wood on each stroke of the hydraulic actuator for highly efficient, fast and safe operation. A removable double-edged blade is mounted on an elongated carriage which telescopically interacts with the frame resulting in a splitter which is very small and compact, extremely maneuverable, and capable of use in rugged terrain. A log positioning cradle holds the wood being split in position on the splitter; additionally, it allows the operator to work from a position of safety in the event that the wood splits violently or attempts to kick out of the splitter. The splitter can split logs up to four feet long and has the ability to split logs which are accidentally cut too long to fit on the splitter. The blade is self-freeing in the event it becomes jammed in the log being split. The balde coupling system allows the splitting blade to be removed for maintenance or replaced with a another style blade; or, it allows the splitter to be used as a hydraulic power unit which may be used with other useful attachments.

24 Claims, 8 Drawing Sheets

DOUBLE-ACTION VERTICAL WOOD SPLITTER

BACKGROUND OF THE INVENTION

This invention relates generally to a hydraulically operated vertical wood splitter and particularly to an improved log splitter which is smaller, faster, safer, easier and more convenient to use than log splitters most commonly in use. An adaptable blade mounting system permits the use of optional attachments, to replace the splitting blade, which allow the fundamental wood splitter structure to function as a multi-purpose hydraulic power unit.

BACKGROUND—DESCRIPTION OF PRIOR ART

Heretofore, log splitters for the production of firewood have been well known and produced in a variety of configurations. The vast majority of these have been hydraulically operated and designed to be moved to remote locations by trailer or tractor. Log splitters are most often powered by a gasoline engine or alternatively by the hydraulic system or mechanical power-take-off of a tractor.

Splitters mounted on trailers are limited by their inherent lack of maneuverability about the job site. It is often difficult to position the splitter precisely and quickly enough for efficient work. The tongue of the trailer on which the splitter is mounted often hampers the operator by interfering with his freedom of movement in the vicinity of the splitter and wood pile. These factors often result in a situation which requires carrying wood to the splitter rather than moving the splitter closer to the wood, and a potentially dangerous situation for the operator working in a cluttered environment.

Log splitters may be roughly categorized by the position in which the axis of the log lies in preparation for splitting: either horizontal and roughly parallel to the earth or, vertical and perpendicular to the earth.

Horizontal splitters are inconvenient to use except when splitting primarily small pieces of wood. Heavy wood presents a difficulty since each piece must be physically lifted off the ground in its entirety, a distance of up to two feet high, and placed on the bed of the splitter. This makes it nearly impossible for a single operator to split very heavy pieces of wood. This situation occurs with splitters designed to split short lengths of wood, in the range of 24 inches or less, if the diameter of the log is large and is even more severe in splitters designed to split logs in the 30 or 48 inch length range. Large diameter logs, longer than 30 inches, may weigh several hundred pounds or more; and, a splitter operator working alone is not able to easily lift them without the use of complicated and expensive log lifting apparatus.

Vertical splitters, on the other hand, simplify the problem of loading a heavy log into position. The log to be split is simply elevated at one end and positioned vertically on the baseplate of the splitter. Once in the vertical position even very heavy logs may be pivoted and walked side to side onto the base platform of the splitter and positioned accurately for splitting. Additionally, a vertical splitter mounted either on the back of a tractor or on the front of a truck, using traditional mounting means, can be far more accurately and quickly maneuvered into the most favorable positions for efficient work than can a horizontal splitter of similar capacity.

Unfortunately, vertical log splitters, especially those which split logs over 24 inches in length, tend to be excessively tall and top-heavy. The height of vertical log splitters is customarily at least twice the length of the largest log which is able to be split. For example, a vertical splitter designed to split logs 2 feet long will be in excess of 4 feet high. A splitter designed to split 4 foot logs, will be in excess of 8 feet tall. Vertical splitters of this type have much of their weight concentrated high above the ground and may therefore be unstable.

These vertical splitters can present serious hazards to the operator and vehicle during transportation due to their propensity to tip the vehicle, particularly when mounted on small tractors which are becoming increasingly popular. Additionally, when a large vertical splitter is transported in heavily wooded areas there is a high potential for injury caused by falling wood which may be dislodged from overhanging branches.

Some splitters employ a convertible setup which allows them to be used in either the vertical or horizontal position. This compromise solution recognizes the superiority of the vertical splitter for splitting and compensates for its height and top-heavy nature by allowing the splitter to be placed in the horizontal position for transportation. Although the splitter can be used in either position, the splitter bed, in the horizontal position, is simply too high above the ground for efficient splitting on a sustained basis. Additionally, these splitters cannot be transported in the vertical position and therefore require extra setup time each time they are moved.

A common difficulty, encountered with splitters of both the horizontal and vertical types, is the tendency of a log being split to fall off the splitter bed during the splitting process. The splitter operator often finds it necessary to use one hand to hold the wood in position, while reaching for the control handle and activating the splitting mechanism with the other hand. Once the wood is in contact with the splitting blade and the splitter frame, the wood is restrained to some extent and no longer requires physical restraint by the operator. However, unless the wood is cut with ends perpendicular to the longitudinal axis of the log, the force of the splitting may still force one end of the log to kick out of the splitting position, often quite violently, and fly off of the splitting frame, possibly causing injury to the splitter operator in the process.

Therefore, an important design feature is one which retains the wood in position without the continuous attention of the operator. This feature allows the operator to initiate and complete the splitting operation from a position of complete safety, preventing the possibility of serious injury, and eliminates the necessity of further effort in lifting the log onto the splitter again.

Occasionally, a piece of wood is encountered which is so tough to split that it causes the splitter to jam with the blade wedged tightly in the wood. Most splitters do not include any provisions for freeing the blade. Removing the jammed wood from the blade can be very tiring and time consuming and the common practice of driving the wood off the blade with a sledge hammer or heavy log often results is a broken splitting blade. Therefore, another useful feature in a splitter is one which simplifies freeing the blade if it becomes jammed in a piece of wood.

Log splitters may be further classified as double-acting or single-acting. Double-acting log splitters split wood on both the extension and retraction stroke of the hydraulic actuator piston rod. Double-acting splitters offer benefits in speed of operation over the single-acting splitter designs, which split only on the extension stroke of the hydraulic actuator piston.

In the case of conventional single-acting splitters, approximately half the time that the splitter mechanism is in operation is spent in recycling the hydraulic actuator in order to bring it into position for loading the next log. Double-acting splitters eliminate this recycle time since wood may be split in each direction of the hydraulic actuators stroke. As each piece of wood is split, the machine is automatically in position for the next piece to be loaded and split.

The double-acting splitter yields a greater degree of productivity than the single-acting splitter by reducing or eliminating the time required to cycle the splitting mechanism to its starting positions. Wood can be split on both strokes of the hydraulic actuator. Additionally, a further speed increase can be achieved when the wood requires being split more than once. A large log can be split once on the extension stroke and, by repositioning, split again on the return stroke. Thereby, the amount of wood handling is reduced to a minimum.

The blades used on log splitters vary greatly from machine to machine. They may however be roughly categorized as wedge shaped or knife-like. The wedge shaped blade splits the wood by forcing the wood halves apart along a line of least resistance following the grain of the wood. The knife-like blade is thinner and sharper than the wedge shaped blade and is able to cut through the grain of the wood when the grain is irregular.

Other blades utilize a combination of the wedge and knife-like forms. These sometimes include additional blades perpendicular to the main blades in order to split the wood into several pieces on one stroke of the splitter. Despite differences in blade design, practitioners of log splitting will agree that a sharp blade is essential to efficient splitting. A sharp blade increases the speed of splitting, and considerably reduces the stresses imposed on the splitting device.

The most effective blade type is dependent on the individual characteristics of the particular wood being split. These often vary subject to local conditions and practices. However, most splitters are not adaptable to different blade types since their blades are permanently attached. A useful feature, therefore, is a blade which can be changed at will for one or another type, or which can be easily removed and replaced for sharpening.

In summary, it is desireable in a splitter to incorporate features which accomplish the following results: it should facilitate the operation of the machine by a single operator; it should be easily and precisely maneuverable about the area in which it is to be used; it should minimize to the greatest extent possible the necessity to move and lift heavy logs; it should provide the operator a high degree of safety during operation and transportation; it should include a wood retaining device; it should be easy to free a jammed blade; it should split wood in both directions to maximize the splitting efficiency of the machine and to optimize the speed of its operation; finally, it should have a blade suitable for local wood conditions which can be removed for sharpening or replacement.

SUMMARY OF THIS INVENTION

There are a number of features which have been incorporated in the design of the practical and efficient logsplitter which is the object of this invention. Among them are: provisions which allows a high degree of productivity and safe operation by a single operator; provisions which allow the splitter to split wood on each stroke of the mechanism; provisions which reduce the overall size and increase the mobility and maneuverability of the log splitter; provisions which hold wood in splitting position; provisions which allow a jammed blade to be easily freed; provisions which allow the splitter to be extremely durable and easily repairable; provisions which allow the log splitter to accept various configurations and types of blades, which adapt the splitter to the requirements of differing types of wood and blade maintenance requirements; and provisions to enable the wood splitter's mechanical mechanisms to function as a multi-purpose power unit which may be used to perform other tasks when it is not needed for splitting wood.

To this end, the invention described herein is a hydraulic logsplitter which is designed to be transported and operated in a generally vertical or near vertical position. The mounting system is designed to allow it to be attached to a vehicle using a conventional three-point hitch.

The splitter of this invention employs a frame comprised of an upper and lower wood restraint and their supports, and a vertical tubular guide member which is attached to the lower wood restraint and passes through a cutout in the upper wood restraining plate. A hydraulic actuator is fitted and supported, piston up, within this tubular guide member.

A second tubular member fits over the vertical guide member through the cutout in the upper wood restraining plate, and is connected near its upper end, to the piston of the hydraulic actuator. The inner surface of the outer tube acts as a guide as it bears on the outer surface of the inner tube. The geometry of the tubes is such that they are restrained from rotating relative to one another. This outer tube is the carriage onto which is mounted a coupling system for attaching the splitting blade.

The blade has a tongue formed in one end which contains holes which match holes in the mating part of the coupling system mounted on the blade carriage. Through these holes, pins or other fastening means are used to secure the blade in position on the carriage.

The double-edged blade is coupled to the base end of the carriage. A conventional hydraulic actuator provides the work force which is controlled by a conventional hydraulic valve via hydraulic lines. The hydraulic actuator moves the carriage vertically, sliding it telescopically over the guide member, causing the double-edged blade to move vertically between the two wood restraining plates.

The rear support member of the splitter incorporates an integral hydraulic fluid tank. This feature reduces the overall size of the splitter, as no external fluid tank is required, and reduces the length of hydraulic hoses required. In addition, the integral tank helps to keep the center of gravity low, reducing the tendency common in vertical splitters, of being top-heavy.

The wood to be split is positioned between the two stationary wood restraints. The front support members, which along with the rear support member maintains the two wood restraints in position, form a cradle against which the wood rests. This cradle acts to hold the wood in position and additionally prevents the wood from being violently thrown sideways as it is being split. This feature allows the operator to stand alongside the splitter, with splitting in progress, in complete safety.

Splitting is accomplished by passing a moving blade through the log parallel to its longitudinal axis. The blade moves, alternately, vertically upward and vertically downward on successive strokes of the hydraulic actuator. The wood is maintained in essentially the same position throughout the splitting process, while the blade moves along a course parallel to, and adjacent to, the position of the hydraulic actuator within the frame. This allows a large log to be split several times in succession while it remains in position on the splitter.

A consequence of this feature is a substantial increase in efficiency and effective speed of operation, as well as producing a substantial reduction of operator effort. This is because the same piece of wood may be split several times, if necessary, without replacing the wood between the blade and the wood restraints.

Also, since the wood is maintained between the two stationary wood restraints it is very easy to free the blade should it become jammed in a particularly tough piece of wood. The blade is simply backed away from the jam while the wood is held in position by one or the other of the restraints.

Additionally, the telescopic nesting of the support tube within the carriage results in a splitter which is much smaller than other splitters of similar log capacity. The splitter of this invention has the capacity to split a log of approximately twice the length of that able to be split by other vertical splitters of similar size.

The height of the splitter, with the hydraulic actuator in its retracted position, is approximately equal to the sum of the length of the hydraulic actuator plus the height of the blade. This design represents a substantial reduction in size, of fifty percent or more in some cases, relative to splitters of traditional design in which the wood to be split is placed in line with the hydraulic actuator.

By way of example, a prototype version of this splitter capable of splitting logs up to four feet long has an overall height of approximately five feet and covers an area of less than two square feet on the ground. Similarly, another prototype version of this same design intended to split logs less than two and one half feet long stands only three and one half feet high.

The splitter of this invention may be transported and is ready to operate with the hydraulic actuator in the retracted position. Moving the splitter is accomplished by simply lifting it with the three-point hitch and moving the vehicle to the desired new location. The splitter's small footprint makes it easy to move it into the desired position quickly and accurately.

The blade of the splitter is removable. The coupling system is designed so that the blade may be quickly and easily removed or replaced. The blade can be removed in the field for sharpening, repair, or for replacement with one designed more appropriately for the particular wood being split.

The blade coupling system allows use of the hydraulic mechanism for purposes other than splitting wood by attaching an accessory tool in place of the standard blade. Other attachments, mounted in place of the splitting blade, allow the splitter's mechanism to be used as multi-purpose power unit which can perform as a hydraulic press, a vehicle jack, a fork lift, or other useful tool.

Therefore, the primary advantages of the splitter of this invention are: it is small in size, e.g. approximately half the size of other vertical splitters with equivalent capacity; it has increased log size capacity, i.e. one man can split logs larger in diameter and longer than with any equivalent size log splitter; wood is automatically held in position on the splitter; the blade can be easily freed if it becomes jammed in the wood; it is easy to maneuver about the job site; it allows a higher production rate of split wood; it is suitable for one man operation; it is adaptable, through the use of removable blades and alternative blade attachments; it is durable. Lastly, it provides a high degree of safety for the operator.

DETAILED DESCRIPTION OF THE PREFERRED EMBODIMENT

Figure 1:
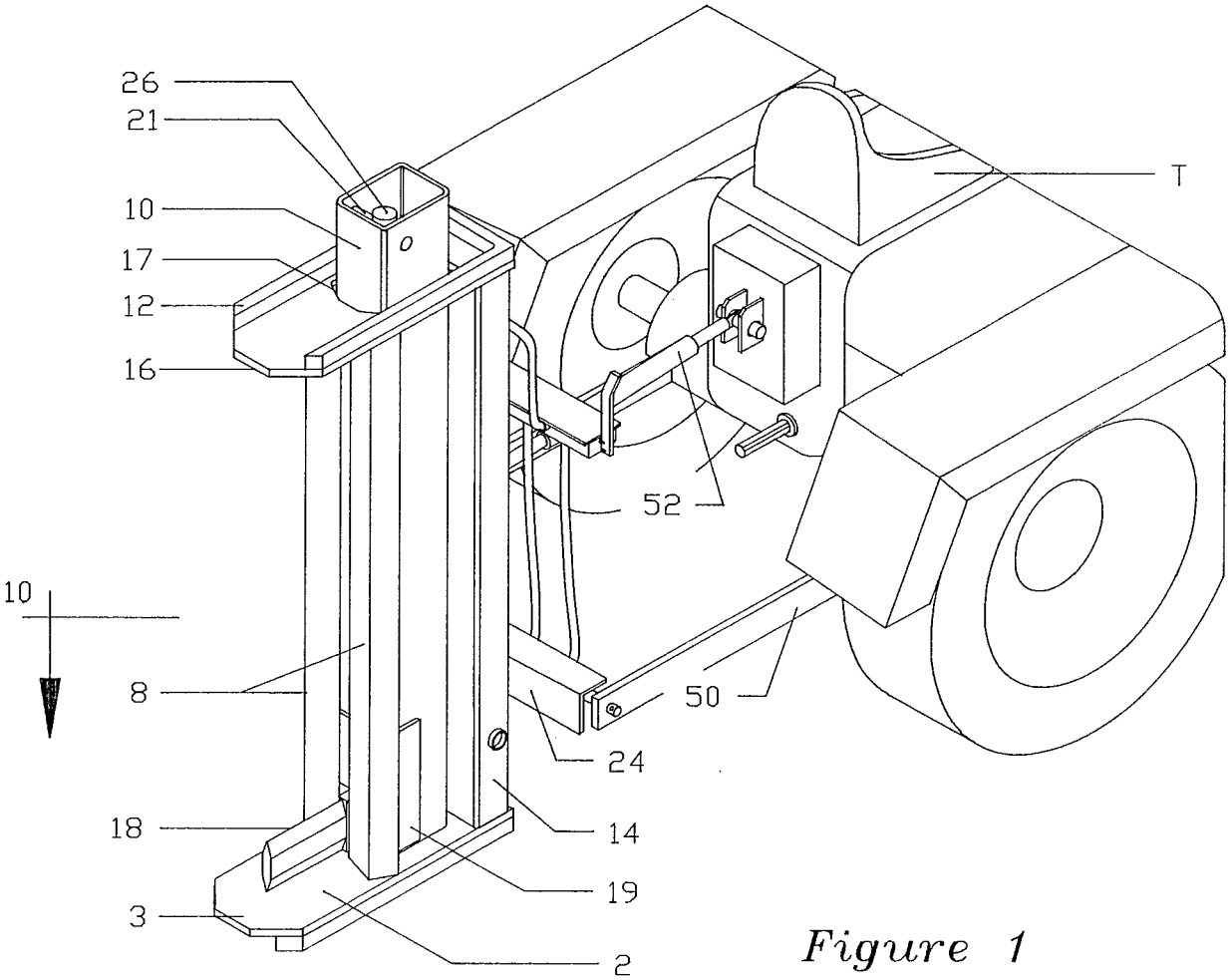
FIG. 1 An isometric view of the log splitter of this invention shown attached to the three point hitch of a tractor.

Refer now to FIG. 1, which is an overall view of a preferred embodiment of the invention. The present invention is a log splitter suitable for mounting on the rear of a tractor (T), by means of a conventional three-point hitch, or on the front of a truck or other conveyance using a conventional snowplow lifting frame or similar arrangement.

The splitter frame consists of a rigid, vertical, generally C-shaped frame comprised of parts (2), (4), (6), (8), (12), (14), (16) and (24) which are welded or otherwise rigidly connected together. Lower wood restraint (2) and upper wood restraint (16) are supported approximately parallel to each other by front support members (8) and rear support member (14). Guide member (6) is rigidly connected perpendicularly to the lower wood restraint (2) and extends parallel to support members (8) and support member (14) through the cut out (17) in wood restraint (16) seen in FIG. 8.

Figure 7:
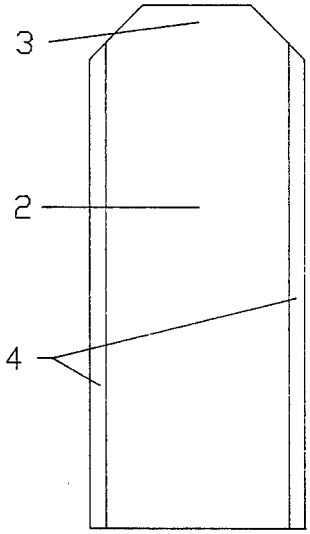
FIG. 7 A plan view showing the underside of the lower wood restraint.
Figure 8:
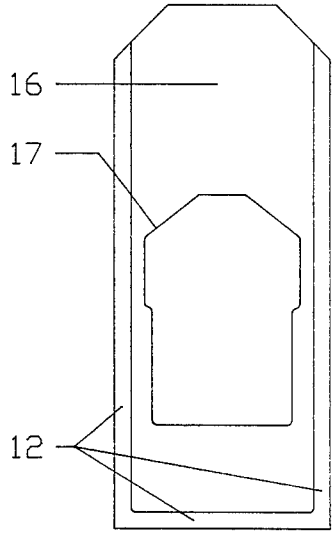
FIG. 8 A plan view showing the top of the upper wood restraint and the cut-out through which the guide member extends.

Lower wood restraint braces (4), shown in FIG. 7, are attached to the bottom surface of the lower wood restraint (2) and limits the deflection of the base under the applied load. Braces (4) also serve as feet when the splitter is in contact with the ground in the operating or storage position. Similarly, brace (12), seen in FIG. 8, is attached to and stiffens the upper wood restraint (16).

Figure 2:
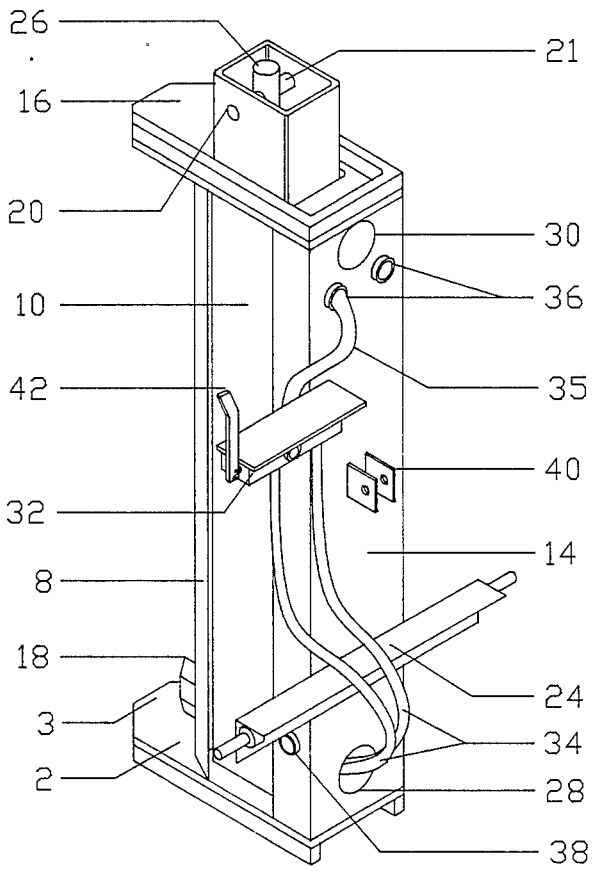
FIG. 2 An isometric view showing a rear view of the logsplitter of this invention.

Referring to FIG. 2, mounting frame (24) and three point hitch top link connector (40) are attached to the back of rear support member (14). Mounting frame (24) has attachment points for hitching to tractor (T) by known means. Mounting conections are made to mounting frame (24) pins and top link connector (40). Tractor draw bar (50) and tractor top link turn buckle (52) are shown in FIG. 1 for illustrative purposes only.

Figure 10:
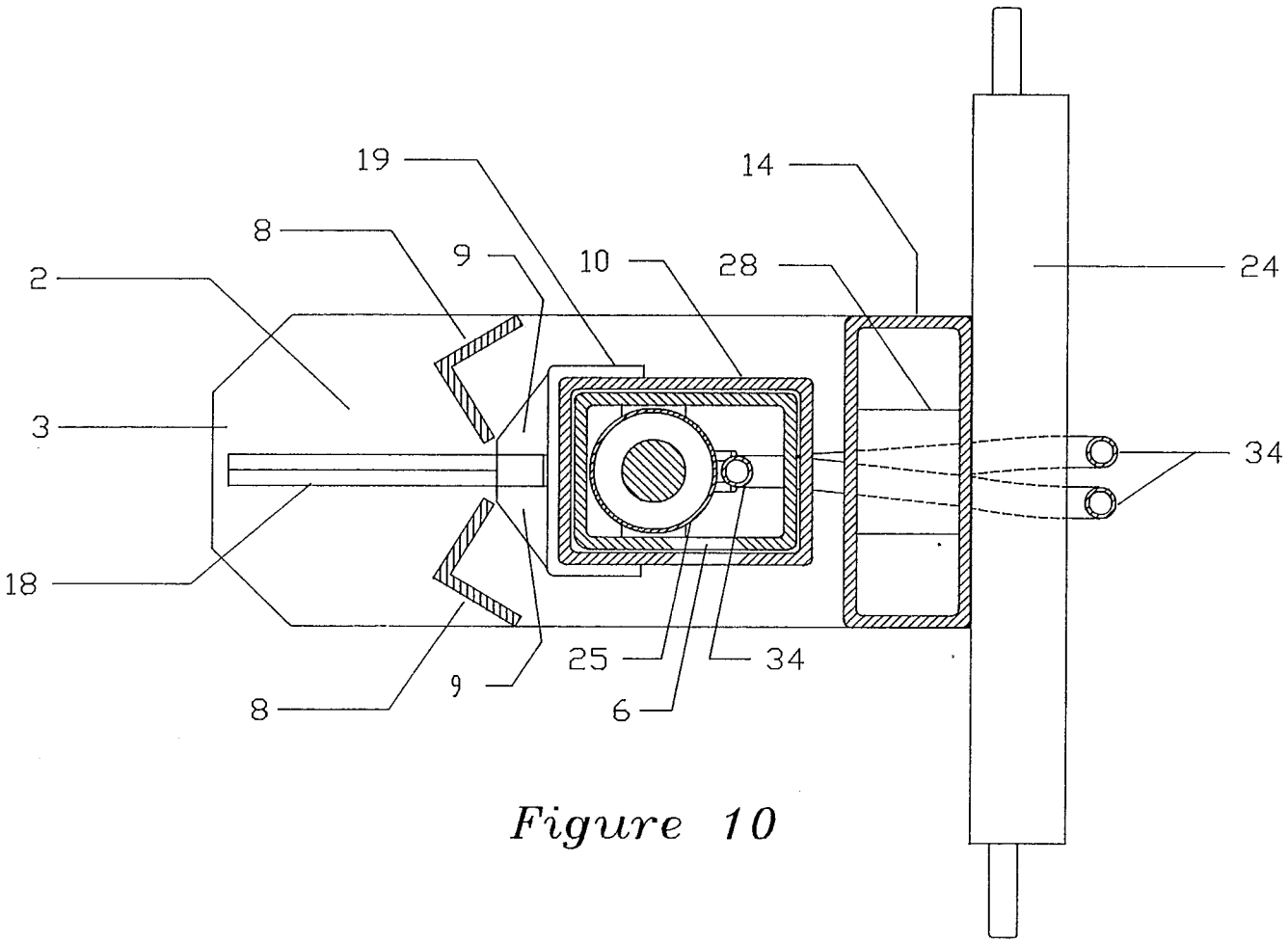
FIG. 10 A plan section view of the splitter cut perpendicular to the guide member at a position approximately half way between the two wood restraints.

As seen in FIG. 10, guide member (6) is tubular and rectangular in cross-section. It is proportioned such that the hydraulic actuator (25) will fit inside it. Hydraulic actuator (25) is inserted through the open top end of guide member (6) with the piston end (26) of the hydraulic actuator (25) up. The inside cross-sectional width of the guide member (6) must be greater than the largest cross-sectional dimension of the hydraulic actuator (25) to allow its insertion into the guide member.

Figure 9:
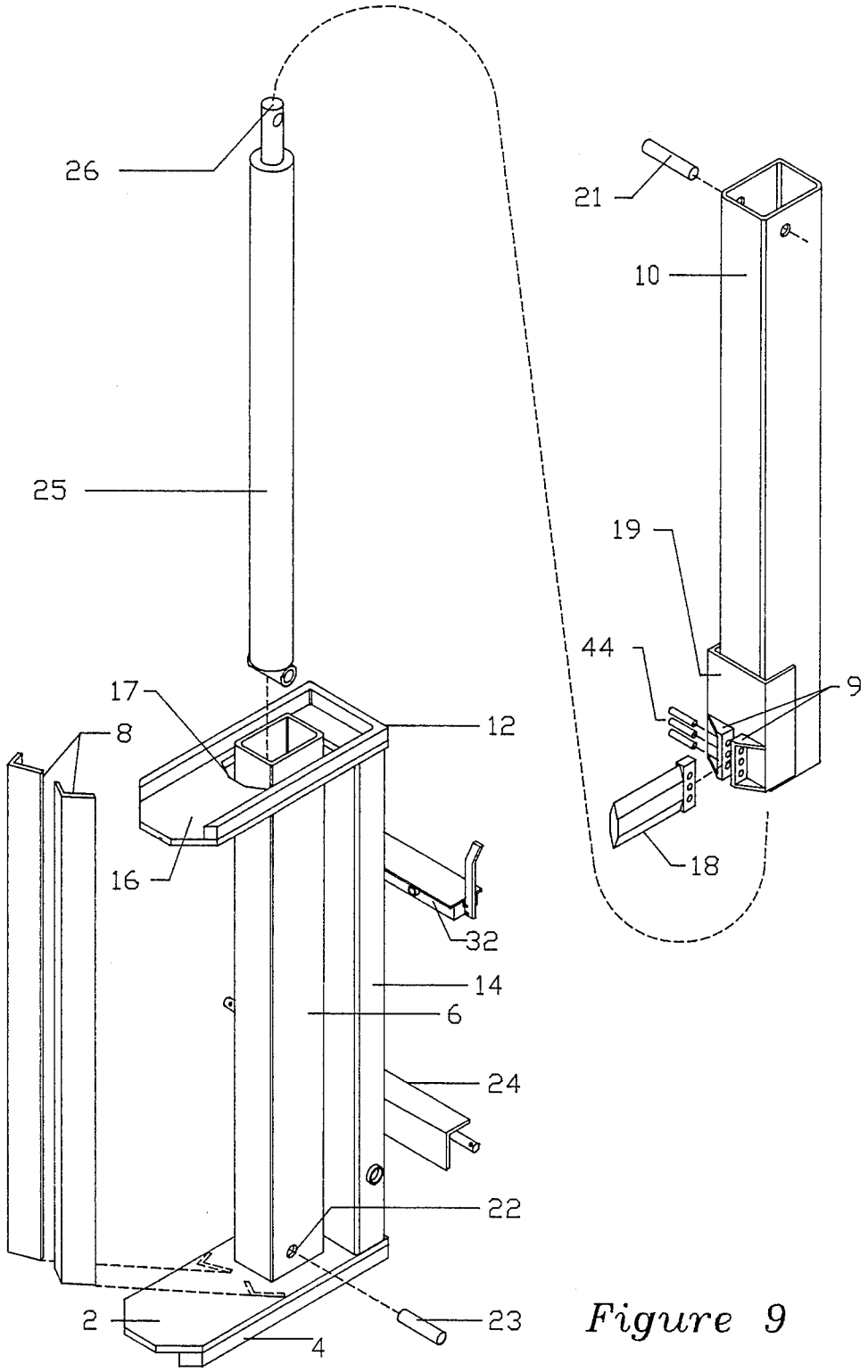
FIG. 9 A partially exploded isometric view showing the assembled support frame, the hydraulic actuator in position for insertion into the guide member, and the carriage to be installed over the guide member. The front support members are shown removed from the frame for the purpose of illustration and clarity. Pins securing the hydraulic actuator to the guide member and carriage are shown.

The hydraulic actuator inserted into guide member (6), as seen in FIG. 9, is connected to the guide member by means of the pin (23). The pin (23) is inserted through holes (22) in the lower end of guide member (6) and through the pin hole at the base of the hydraulic actuator (25). The length of the guide member is such that with the hydraulic actuator (25) inserted and attached to it, the end of the piston (26) extends beyond the top of the guide member (6).

Figure 3:
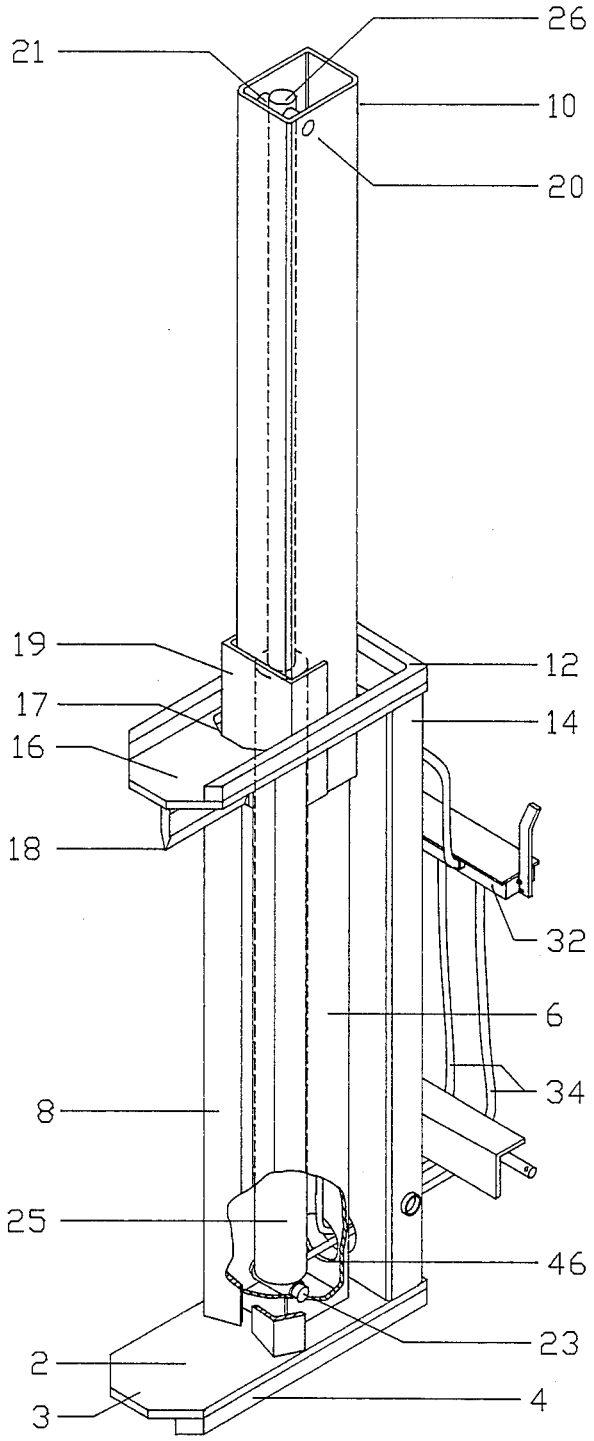
FIG. 3 An isometric view of the log splitter showing the position of the blade and blade carriage when the piston of the hydraulic actuator is extended. The cut out section illustrates the position of the base of the hydraulic actuator within the guide member.

Hydraulic hoses (34) attach to the hydraulic actuator (25) and travel inside guide member (6) passing through hole (46), shown in the cut-away section of FIG. 3, in the lower end of guide member (6). They proceed through passage (28) in the rear support member (14), as seen in FIG. 2, and attached to the hydraulic valve (32). Therefore, the inside cross-sectional length of the guide member (6) must provide sufficient clearance to allow hydraulic hoses to run inside it, adjacent to the hydraulic actuator as illustrated in FIG. 10.

Figure 6:
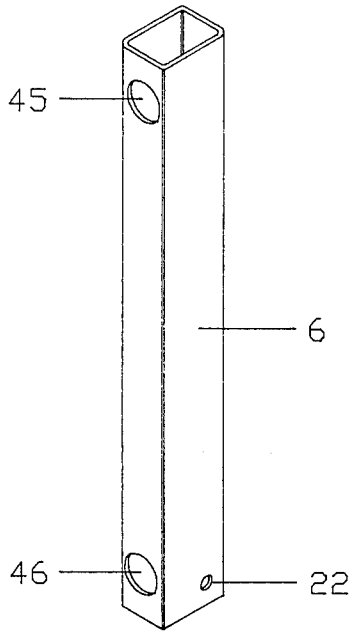
FIG. 6 An isometric rear view of the guide member showing cut-outs near its top and bottom for access to hydraulic actuator hose connections.

Passage (30), seen in FIG. 2, passes through support member (14) and lines up with hole (45) located near the top of the guide member, seen in FIG. 6, to give access to the hydraulic hose connection near the top of the hydraulic actuator.

In the preferred embodiment, support member (14) is comprised of a tubular frame member which incorporates an integral liquid tank for use as a reservoir to contain sufficient hydraulic fluid to provide for the requirements of the system. Illustrated in FIG. 2, support member, i.e. hydraulic reservoir (14) is provided with several threaded ports (36) and (38) for connection to hydraulic lines.

Port (38) contains an in-tank strainer which connects to a hydraulic line leading to the inlet of a hydraulic pump. A hydraulic pump of conventional design delivers the working pressure to the system through hydraulic valve (32). Fluid is returned from valve (32) to the reservoir (14) via a hydraulic line (35).

Additionally, the hydraulic reservoir (14) is provided with two passages, (28) and (30), which pass entirely through the reservoir. These passages are made by welding sections of pipe between holes drilled through the reservoir. The passages (28) and (30) are located so that they align with holes (46) and (45), respectively, in guide member (6). Passage (28) allows access, through hole (45) in guide member (6), to the lower end of the hydraulic actuator (25). Passage (30) permits access, through hole (45) in guide member (6), to the hydraulic line connection at the upper end of hydraulic actuator (25).

Support members (8) are two identical braces attached between the lower and upper wood restraints. Each is located slightly to the side of and adjacent to the line of travel of the blade (18). When the splitter is tilted to the rear, into its operating position, the two support members (8) form a cradle which holds the wood being split in position. FIG. 10 best illustrates the orientation of this wood cradle (8). It should be understood that the cross-sectional shape of the wood cradle shown represents the preferred embodiment, but various changes in the size, shape and arrangement of the parts may be undertaken without departing from the spirit of the invention.

In the preferred embodiment, guide member (6) and carriage (10) are rectangular in cross-section, as seen in FIG. 10. The outside cross-sectional dimensions of the guide member are slightly smaller than the inside cross-sectional dimensions of the carriage (10) so that sliding of the carriage (10) on the guide member (6) may occur without either binding or excessive free play.

Due to the large area of contact between the carriage and the guide member, and because of the collinear motion of the hydraulic actuator piston (6) and the carriage (10), no additional bearing material is required provided the gap between the tubes is sufficiently small. A gap of approximately one eighth of an inch between the outer surface of the guide member and the inner surface of the carriage is sufficiently great to allow free movement of the carriage, and small enough to insure that free play of the carriage on the guide member is within acceptable limits.

To this end, rectangular structural tubing in standard sizes commonly available from steel producers has been used, with great success, for the guide member and the carriage. Use of this material in standard sizes reduces the manufacturing costs associated with the production of the splitter. However, the broad concept of this invention is such that tubing of any cross-sectional shape may be used for the guide member (6) when used with tubing of corresponding cross-sectional shape for the carriage (10).

The carriage (10) slides over the top of the guide member (6) which contains hydraulic actuator (25) and through the cutout in wood restraint (16) surrounding guide member (6) along its entire length. Sufficient clearance is provided between the cutout (17) in upper wood restraint (16) and guide member (6) to allow the carriage (10) to move without friction.

Figure 5:
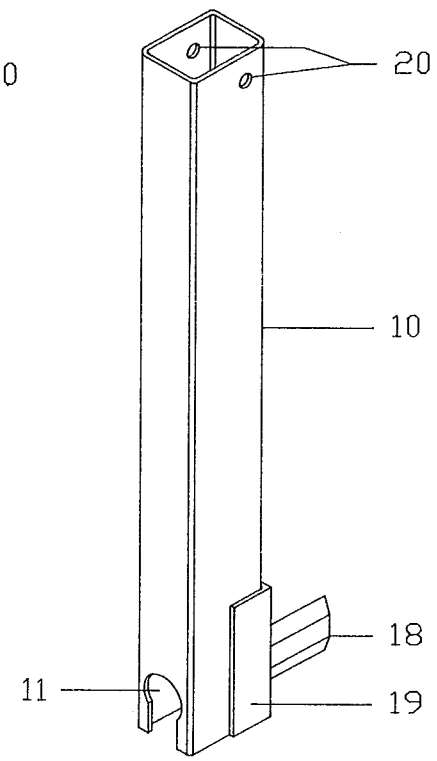
FIG. 5 An isometric rear view of the blade carriage with the blade mounted and showing the cut-out near the base of the carriage.

Pin (21), seen in FIG. 9, attaches the carriage (10) to hydraulic actuator's (25) pin hole at the piston end (26) through holes (20) near the top end of carriage (10). At its base, carriage (10) contains a cut out, shown in FIG. 5, to avoid interference with the hydraulic hoses which pass through hole (46) in guide member (6) and passage (28) in the hydraulic reservoir.

Figure 4:
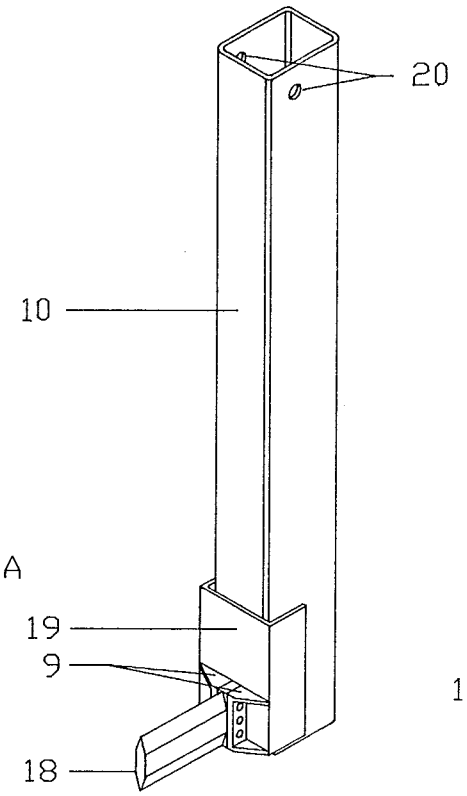
FIG. 4 An isometric view showing an enlargement of the blade and the coupling means; and, a view of the blade and coupling means attached to the blade carriage.
Figure 4:
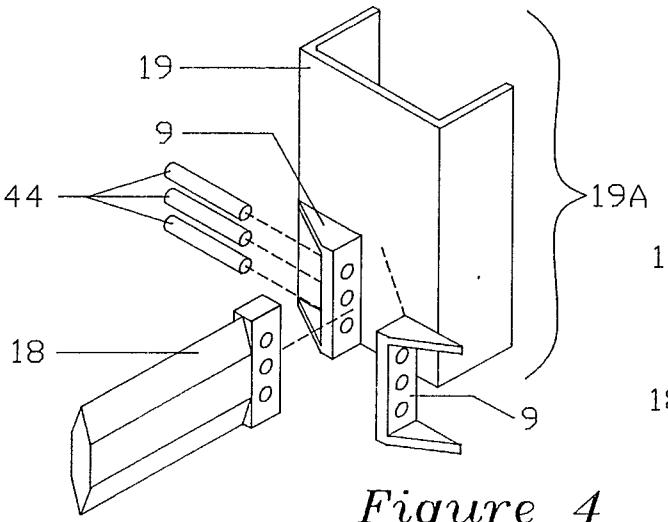

Blade coupling means (19A), shown enlarged in FIG. 4, consists of parts (9), (19), and (44). Carriage reenforcing means (19) is a bracket rigidly attached to the lower end of carriage (10) by welding or other suitable means. The carriage reenforcing means (19) acts as a mounting platform for blade receiver (9) and serves to stiffen and reenforce the end of the carriage (10).

Blade receiver (9) is comprised of two identical brackets, each containing several equally spaced holes. The two brackets, with their respective holes aligned, are equally spaced from the vertical center line of and rigidly attached to the carriage reenforcing means (19). The brackets are spaced a distance apart equal to the width of the blade.

One end of the wood splitting means (18), hereinafter referred to as the blade (18) has a tongue of rectangular cross-section which is provided with holes that identically match those of the blade receiver (9). The double-edged blade (18) has two sharpened parallel edges on opposite sides of the blade. The blade is fastened to the blade receiver (9) by means of pins (44) in such a way that the blade (18) is perpendicular to the lower and upper wood restraints, (2) and (16), and the sharpened edges are generally parallel to the lower and upper wood restraints.

Pins (44) are hardened dowel pins which tightly fit the holes in the blade receiver (9) and blade (18). They allow the blade to be easily removed, when necessary, for sharpening or for replacement with a blade of a different design. Pins (44) may alternatively be replaced with bolts, screws or other known fastening means. It is to be understood that this blade mounting arrangement herein shown and described is taken as a preferred example of the same and that various changes in the size, shape and arrangement of the parts may be undertaken without departing from the spirit of the invention.

Figure 11:
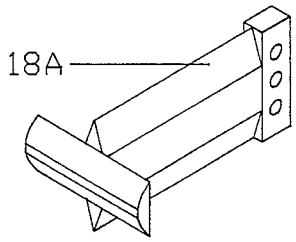
FIG. 11 Isometric views of several attachments which may be connected to the coupling means. Parts 18A, 18B, and 18C are a three way double-edged splitting blade, a hydraulic press attachment, and a vehicle frame jack attachment.
Figure 12:
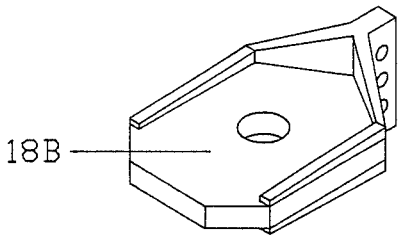
Figure 13:
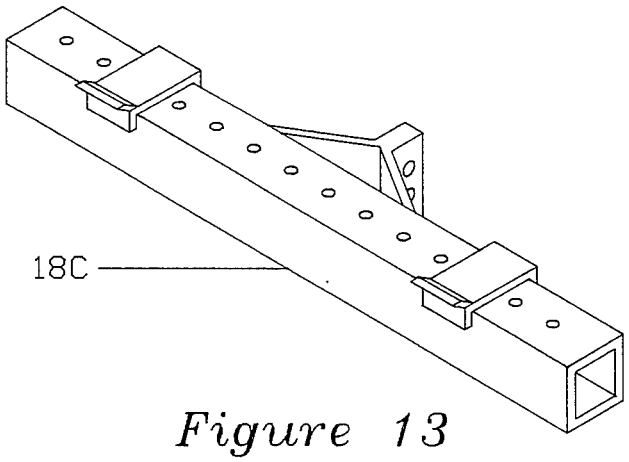

FIG. 11 shows several alternative attachments which may be connected to the blade receiver. Each of these attachments has one end which has a rectangular cross-section similar to that of blade (18), and holes which match those of the blade receiver. An alternative splitting blade (18A) is designed to split wood into three pieces and operate in both directions of the hydraulic actuator. Attachment (18B) is designed to be used with the hydraulic power unit in cooperation with the upper or lower restraints as a hydraulic press. Attachment (18C) is designed to be used as a jack for lifting a vehicle by the frame or bumper.

In operation, the splitter is attached to a tractor three-point hitch or other vehicle with a suitable mount by means of connections to mounting frame (24) pins and top link bracket (40). The splitter is inclined slightly, approximately five to fifteen degrees, to the rear by adjusting the three point hitch top link turnbuckle attached to bracket (40). This results in lower wood restraint (2) and blade (18) being inclined above the horizontal such that the toe (3) of the lower wood restraint (2) is raised slightly off the ground and support members (8) are inclined rearward toward the mounting vehicle. The splitter in this position may be lifted by the three point hitch and transported wherever necessary, and is ready for splitting operation. The particular angle of incline used will be determined by operator preference, the characteristics of the wood being split, and peculiarities of the terrain.

Although the splitter may be operated with three point hitch holding the splitter in the raised position, the splitter is generally lowered into contact with the ground for splitting, especially when splitting large, heavy pieces of wood. The initial position of the splitter is illustrated in FIG. 1.

A piece of wood is lifted by one end into the vertical position. The piece of wood is then lifted slightly and placed on the blade (18) and cradled by the support members (8) between blade (18) and wood restraint (16). The angle formed by the support member, (8) forms a cradle in which the wood rests. The shape of the cradle and the weight of the log leaning against it cooperate to prevent the wood from falling out of the splitting position. The extent to which the wood is held in position is determined by the angle of incline of the splitter; however, this angle generally need not be very great.

Splitting is accomplished by pushing the hydraulic valve control handle (42) upwards. The blade (18), under the influence of hydraulic actuator (25) in cooperation with carriage (10), is pulled from its position adjacent to lower wood restraint (2) toward the upper wood restraint (16) pushing the log to be split ahead of it. When the upper end of the log contacts the upper wood restraint the blade penetrates the log from the bottom and begins to split the log. The blade (18) continues its course through the log, while the log remains stationary, until the blade splits the wood and reaches the extent of its travel with hydraulic actuator piston (26) fully extended. At this point, the blade (18) is adjacent to upper wood restraint (16) and the split log is resting on the lower wood restraint (2). This position is illustrated by FIG. 3.

If the log being split is very large it may need to be split again. It can be rotated a partial turn in position and split again without otherwise repositioning since the lower end of the log will now be resting on the lower wood restraint (2). If the log has been split sufficiently, a new log may be placed on the splitter without the necessity of recycling the hydraulic actuator to its collapsed position. In that case, the next log is placed between the blade, and the lower wood restraint (2), resting in the support member, i.e. cradle (8). The splitter is activated by pulling the hydraulic valve control handle down. The blade then travels downward, contacting and penetrating the log. The stroke ends when the splitter is once again in the position as illustrated in FIG. 1 with the hydraulic actuator in its collapsed position and the blade (18) is adjacent to the lower wood restraint (2).

Occasionally, a log is encountered which has been cut several inches too long to enable it to be placed in position between the blade and the wood restraint. It is possible to split such a log by placing the log on the ground, laying parallel to the cutting edge of the blade, with one of its ends resting on the lower wood restraint adjacent to the wood cradle. The blade is then lowered from above and penetrates the log from the side near its end. Raising the blade then lifts the log and allows it to be pivoted about the blade into the vertical position with the base of the log resting on the lower wood restraint. The log may then be split in the usual fashion. This method allows a log approximately six to eight inches longer than the nominal capacity of the splitter to be split. Additionally, this method may also be used to place extremely heavy logs into splitting position, if they cannot be easily placed on the splitter otherwise.

It will be observed from the foregoing that numerous variations in size shape and arrangement of the parts and modifications of the design of this wood splitter may be effected without departing from the true spirit and scope of this invention. It should be understood that no limitation with respect to the specific apparatus herein described is intended or should be inferred.

Having thus described my invention, I claim:

1. A vertical double-action wood splitter adapted to be mounted on a vehicle, comprising:
   (a) a substantially vertical frame with an upper and lower wood restraining means projecting generally horizontally therefrom at respective ends thereof and a generally vertical guide member;
   (b) an elongated carriage slidably mounted for reciprocating motion on said guide member;
   (c) a wood splitting means removably mounted on said carriage;
   (d) a coupling means for operatively interconnecting said wood splitting means with said carriage, thereby permitting easy removal of said wood splitting means from said carriage;
   (e) two way activating means mounted within said vertical frame wherein said two way activating means is operatively interconnected with said carriage and said wood splitting means for driving said wood splitting means alternately upward and downward between said upper and lower wood restraining means for splitting wood.

2. The double-action wood splitter as recited in claim 1, wherein the frame further comprises:
   a plurality of elongated support members of substantially equal length, wherein said support members are mounted between the lower wood restraining means and the upper wood restraining means in a spaced relationship around the guide member, said elongated support members including:
   a rear support member located between said guide member and the vehicle, wherein said rear support member comprises
   a integral hydraulic fluid tank; and,
   a front support member located adjacent to said guide member laterally opposite said rear support member, wherein said front support member further comprises a log positioning cradle means whereby a log is held in position for splitting.

3. The double-action wood splitter as recited in claim 2, wherein the rear support member is provided with a mounting means for attaching the logsplitter to a vehicle.

4. The double-action wood splitter as recited in claim 1, wherein the carriage and the guide member are tubular, and wherein the inside cross-sectional dimensions of said carriage substantially conforms to the outside cross-sectional dimensions of said guide member, thereby permitting said carriage to slide easily on said guide member.

5. A double-action wood splitter as recited in claim 1, wherein the wood splitting means comprise:
   (a) a coupling tongue formed in one end of said wood splitting means whereby said wood splitting means is attached to the carriage; and,
   (b) a blade with two substantially parallel oppositely disposed knife-like edges.

6. The double-action wood splitter as recited in claim 5, wherein the wood splitting means is removable, thereby permitting easy repair of said wood splitting means and thereby permitting replacement of said wood splitting means with a blade having the coupling tongue.

7. The double-action wood splitter as recited in claim 1, wherein the coupling means comprises:
   (a) a carriage reenforcing means being secured to the carriage;
   (b) a blade receiver means secured to said carriage reenforcing means whereby the wood splitting means is mounted on the carriage;
   (c) a fastening means for releasably securing the wood splitting means to said blade receiver means.

8. The double-action wood splitter as recited in claim 1, wherein the two way activating means is a hydraulic actuator operatively connected with the carriage and the wood splitting means for driving said wood splitting means through a log.

9. A double-action wood splitting apparatus comprising:
   (a) a generally vertical guide member;
   (b) a lower wood restraint being joined approximately normally to one end of said vertical guide member;
   (c) a plurality of elongated support members of substantially equal length being mounted approximately normally to said upper surface of the lower wood restraint in a spaced relationship around said guide member;
   (d) an upper wood restraining means being mounted approximately normally to said elongated vertical support members and aligned with and approximately parallel to said lower wood restraining means;
   (e) a carriage slidably mounted on said guide member for reciprocating motion with respect to said guide member;
   (f) a wood splitting means associated with said carriage and moveable therewith between said lower wood restraining means and said upper wood restraining means;
   (g) a coupling means for operatively interconnecting said wood splitting blade means and said carriage;
   (h) two way activating means mounted within said guide member for driving said carriage and said wood splitting blade means alternatively toward said upper wood restraining means and said lower wood restraining means.

10. A double-action wood splitter as recited in claim 9, wherein the upper wood restraining means and the lower wood restraining means each comprises a substantially flat steel plate.

11. A double-action wood splitter as recited in claim 9, wherein the upper wood restraining means contains a cutout through which the vertical guide member extends.

12. A double-action wood splitter as recited in claim 9, wherein one of the elongated support members comprises an integral hydraulic fluid tank.

13. A double-action wood splitter as recited in claim 9, wherein the elongated support members are provided with a mounting means for attaching the logsplitter to a vehicle.

14. A double-action wood splitter as recited in claim 9, wherein the elongated support members adjacent to the wood splitting means comprise a log positioning cradle whereby a log is maintained in position during splitter operation.

15. A double-action wood splitter as recited in claim 9, wherein the wood splitting means comprise:

(a) a blade with two substantially parallel oppositely disposed knife-like edges;

(b) a coupling tongue formed in one end of said blade for operatively interconnecting said wood splitting blade means with the carriage.

16. A double-action wood splitter as recited in claim 9, whereby the coupling means permits easy removal of the wood splitting means from the carriage, and wherein said coupling means comprises:

(a) a carriage reenforcing means being secured to said carriage;

(b) a blade receiver means being secured to said carriage reenforcing means whereby said wood splitting means is mounted on said carriage;

(c) a fastening means for releasably securing said wood splitting means to said blade receiver means.

17. A double-action wood splitter as recited in claim 9, wherein the two way activating means is a hydraulic actuator mounted within and secured to the guide member, the piston end of said hydraulic actuator extending beyond the upper end of said guide member.

18. A double-action wood splitter as recited in claim 9, wherein the carriage is fitted over the guide member and the two way activating means, through a cutout in the upper wood restraining means, whereby said carriage surrounds said guide member and said two way activating means along said guide members entire length, and wherein said carriage is attached to said two way activating means near the top of said carriage.

19. A double-action wood splitting apparatus adapted to be mounted on a vehicle, comprising:

(a) a generally vertical guide member;

(b) a lower wood restraining means being joined approximately normal to said guide member;

(c) an upper wood restraining means being mounted substantially parallel to and aligned with said lower wood restraining means;

(d) a plurality of elongated support members of substantially equal length;

(e) said elongated support members being joined approximately normal to the upper surface of said lower wood restraining means and approximately normal to the lower surface of said upper wood restraining means at spaced locations about said guide member;

(f) a carriage encompassing said guide member slidably mounted for reciprocating motion on said guide member, wherein the inside cross-section of said carriage substantially conforms to the outside cross-section of said guide member;

(g) a wood splitting means associated with said carriage and alternatively movable between said upper wood restraining means and said lower wood restraining means, wherein said wood splitting means comprises:

a coupling tongue formed on one end of said wood splitting means for operatively interconnecting said wood splitting means with said carriage, wherein said coupling tongue further comprises a plurality of holes; and, a blade with at least one knife-like edge;

(h) a coupling means for interconnecting said wood splitting means with said carriage, thereby permitting easy removal of said wood splitting means from said carriage, wherein said coupling means comprises:

a carriage reenforcing means being secured to said carriage;

a blade receiver means being secured to said carriage reenforcing means, wherein said blade receiver further comprises a plurality of pairs of vertically aligned holes, spatially conforming with holes in the coupling tongue;

a plurality of pins for releasably securing said coupling tongue to said blade receiver means, wherein said pins substantially conform in cross-section to the holes in said blade receiver means and said coupling tongue;

(i) a two way activating means mounted within said guide member operatively interconnected with said carriage and said wood splitting means for driving said wood splitting means alternatively toward the upper surface of said lower wood restraining means and the lower surface of said upper wood restraining means.

20. A double-action wood splitter as recited in claim 19, wherein the elongated support members comprise:

(a) a rear support member mounted between the lower wood restraining means and the upper wood restraining means, and located between the guide member and the vehicle;

(b) a front support member mounted between said lower wood restraining means and said upper wood restraining means, located adjacent to said guide member, laterally opposite said rear support member.

21. A double-action wood splitter as recited in claim 19, wherein the rear support member comprises an integral hydraulic fluid tank.

22. A double-action wood splitter as recited in claim 19, wherein the rear support member is provided with a mounting means for attaching the logsplitter to a vehicle.

23. A double-action wood splitter as recited in claim 19, wherein the two way activating means is a hydraulic actuator mounted within and secured to the guide member, the piston end of said hydraulic actuator extending beyond the upper end of said guide member and wherein said piston end is connected to the carriage.

24. A double-action wood splitter as recited in claim 19, wherein the coupling means permits the easy attachment of an alternate wood splitting means having a coupling tongue.

* * * * *